US007322670B2

(12) United States Patent
Hayashi

(10) Patent No.: US 7,322,670 B2
(45) Date of Patent: Jan. 29, 2008

(54) INKJET RECORDING APPARATUS

(75) Inventor: Akira Hayashi, Daito (JP)

(73) Assignees: Funai Electric Co., Ltd., Daito-shi (JP); Lexmark International, Inc., Lexington, KY (US)

( * ) Notice: Subject to any disclaimer, the term of this patent is extended or adjusted under 35 U.S.C. 154(b) by 264 days.

(21) Appl. No.: 10/893,536

(22) Filed: Jul. 19, 2004

(65) Prior Publication Data

US 2005/0041058 A1 Feb. 24, 2005

(30) Foreign Application Priority Data

Jul. 17, 2003 (JP) ..... 2003-198171

(51) Int. Cl.
*B41J 2/165* (2006.01)

(52) U.S. Cl. ..... 347/32; 347/22; 347/29

(58) Field of Classification Search ..... 347/32
See application file for complete search history.

(56) References Cited

U.S. PATENT DOCUMENTS 6,497,473 B2 * 12/2002 Kim ..... 347/33
6,517,185 B1 * 2/2003 Aldrich ..... 347/29
6,578,949 B2 * 6/2003 Takahashi et al. ..... 347/30

FOREIGN PATENT DOCUMENTS

JP 4-94943 A 3/1992
JP 4-040937 U 4/1992
JP 5-330072 A 12/1993
JP 7-40541 A 2/1995
JP 9-309210 A 12/1997
JP 2000-141676 A 5/2000
JP 2001-287374 10/2001
JP 2001-347677 A 12/2001

OTHER PUBLICATIONS

Japanese Office Action dated Feb. 23, 2007 with English translation (Seven (7) Pages).

* cited by examiner

*Primary Examiner*—Matthew Luu
*Assistant Examiner*—Brian J. Goldberg
(74) *Attorney, Agent, or Firm*—Crowell & Moring LLP

(57) ABSTRACT

An inkjet recording apparatus includes: a slider 30 movable back and forth with respect to a fixed base 4 disposed near a home position of an ink cartridge 10; a cap 20 which is attached to the upper part of the slider 30, formed of an elastic member that is opened on its upper end portion 21 so as to cover the head surface 11 of the ink cartridge 10, narrowed at the middle portion 22, and widened toward the lower end portion 23; and a cam mechanism 5 which changes the pressure inside the cap 20 from a positively pressurized status into a negatively pressurized status when the ink cartridge 10 moves within the home position, and at a standby state, maintains the negatively pressurized status so that the cap 20 adsorbs to the head surface 11.

10 Claims, 9 Drawing Sheets

INKJET RECORDING APPARATUS

BACKGROUND OF THE INVENTION

1. Field of the Invention

The present invention relates to an inkjet recording apparatus such as an inkjet printer or plotter which jets ink from an ink jetting hole, and more specifically, a capping device to be covered on the head surface for protecting the head surface of an ink cartridge and preventing clogging that is caused by drying of residual ink.

2. Description of the Related Art

In an inkjet recording apparatus such as an inkjet printer or plotter, printing is carried out by jetting ink from an ink jetting hole formed in the head surface of an ink cartridge that reciprocates.

In such an inkjet recording apparatus using an ink cartridge, when the ink cartridge is positioned at its home position (home station), printing is not carried out, so that if the head surface is left without protection, ink adhering to the head surface is dried, and this causes clogging, etc. Herein, the home position means a non-printing region set aside of a printing operation region in order to make the head surface for printing of the ink cartridge to withdraw from the printing operation region and standby after completion of the printing operation.

Considering this point, in the prior arts, for example, at the home position that is the initial position of the ink cartridge, in order to protect the head surface and prevent clogging that is caused by drying of the residual ink, between a cap and a slider that moves back and forth while retaining the cap, a capping device is formed by providing a structural part with rigidity smaller than that of the cap, and the head surface is covered by this capping device (for example, see JP-A-2001-287374).

In the structure disclosed in JP-A-2001-287374, a spring or the like that was used in the prior arts is not used, so that the number of component parts can be reduced, and this is preferable. However, the rigidity of the cap is greater than the rigidity of the structural part, that is, the cap is harder than the structural part, and this poses a problem in smoothness on the surface of the cap which comes into contact with the head surface, and if the smoothness is low, air-tightness when the head surface is covered is deteriorated. Maintaining the smoothness results in an increase in manufacturing costs, and even if high smoothness is obtained, the surface is worn out during use, resulting in deteriorated air-tightness, and this makes it impossible to use the apparatus for a long period of time.

SUMMARY OF THE INVENTION

The present invention has been made in order to solve the aforementioned problem, and one of objects of the invention is to provide an inkjet recording apparatus and a capping device which can be used for a long period of time by reducing the number of component parts by omitting a spring, like in the document JP-A-2001-287374 mentioned above, and effectively improving air-tightness inside a cap covering the head surface of the ink cartridge and preventing the ink from being dried.

According to one aspect of the invention, there is provided an inkjet recording apparatus that carries out recording by jetting ink onto a recording medium by using an ink cartridge of inkjet type which ejects ink from an ink jetting hole, the inkjet recording apparatus including: a base fixedly disposed near a home position of the ink cartridge; a slider that moves back and forth with respect to the base in a direction of a movement direction of the ink cartridge; a cap disposed on the slider at a side where opposes to a head surface of the ink cartridge and being formed of an elastic member which is opened on upper end portion thereof, narrowed at a middle portion thereof, and widened toward a lower end portion thereof, the upper end portion being configured to cover the head surface of the ink cartridge.

BRIEF DESCRIPTION OF THE DRAWINGS

The above objects and advantages of the present invention will become more apparent by describing preferred exemplary embodiments thereof in detail with reference to the accompanying drawings, wherein.

DETAILED DESCRIPTION OF THE PREFERRED EMBODIMENTS

Referring now to the accompanying drawings, a description will be given in detail of preferred embodiments of the invention.

Figure 1:
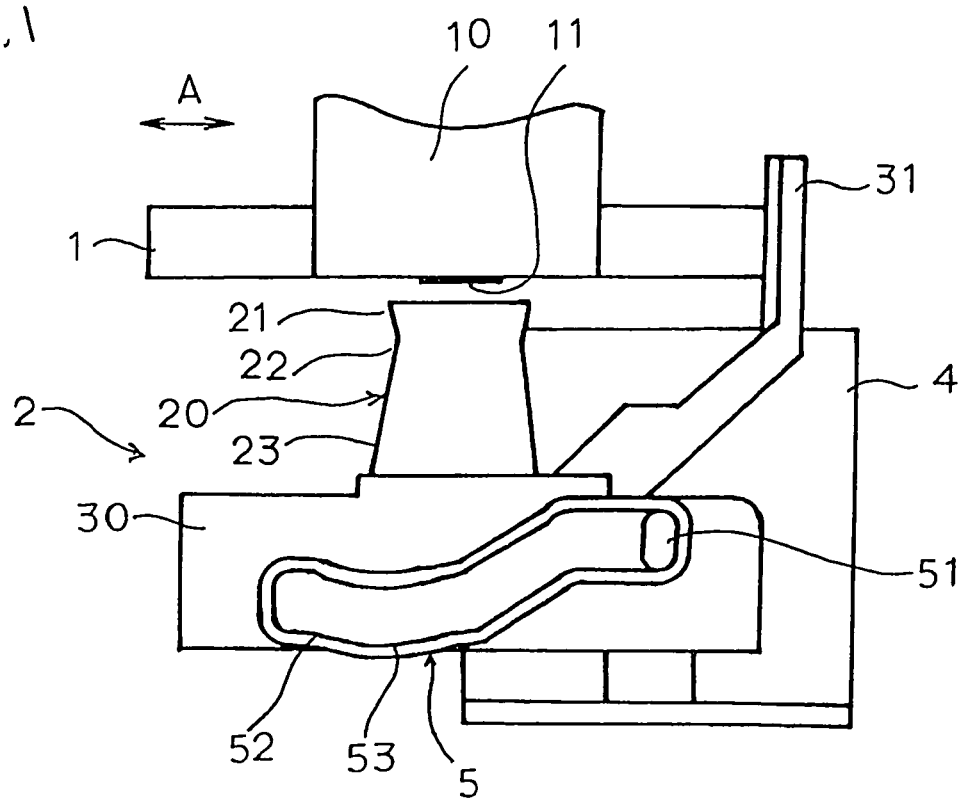
FIG. 1 is a schematic constructional view showing the main part of the capping device of the inkjet recording apparatus according to an embodiment of the invention.
Figure 2A:
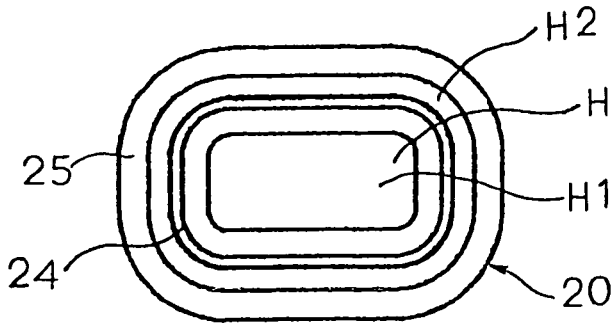
FIG. 2A shows a top view of an example of the cap.
Figure 2B:
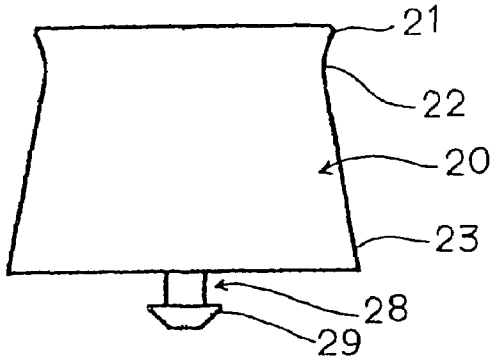
FIG. 2B shows a front view of the cap.
Figure 2C:
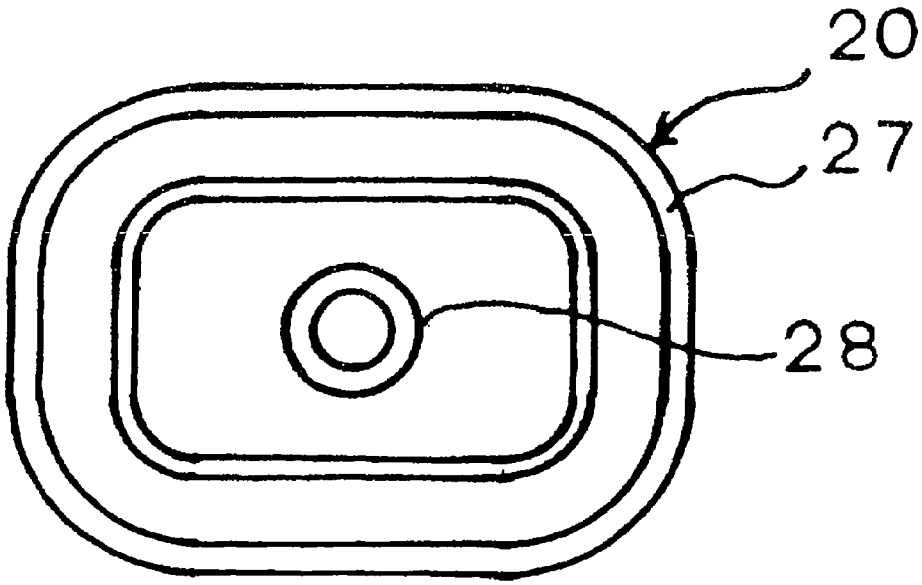
FIG. 2C shows a bottom view of the cap.
Figure 3:
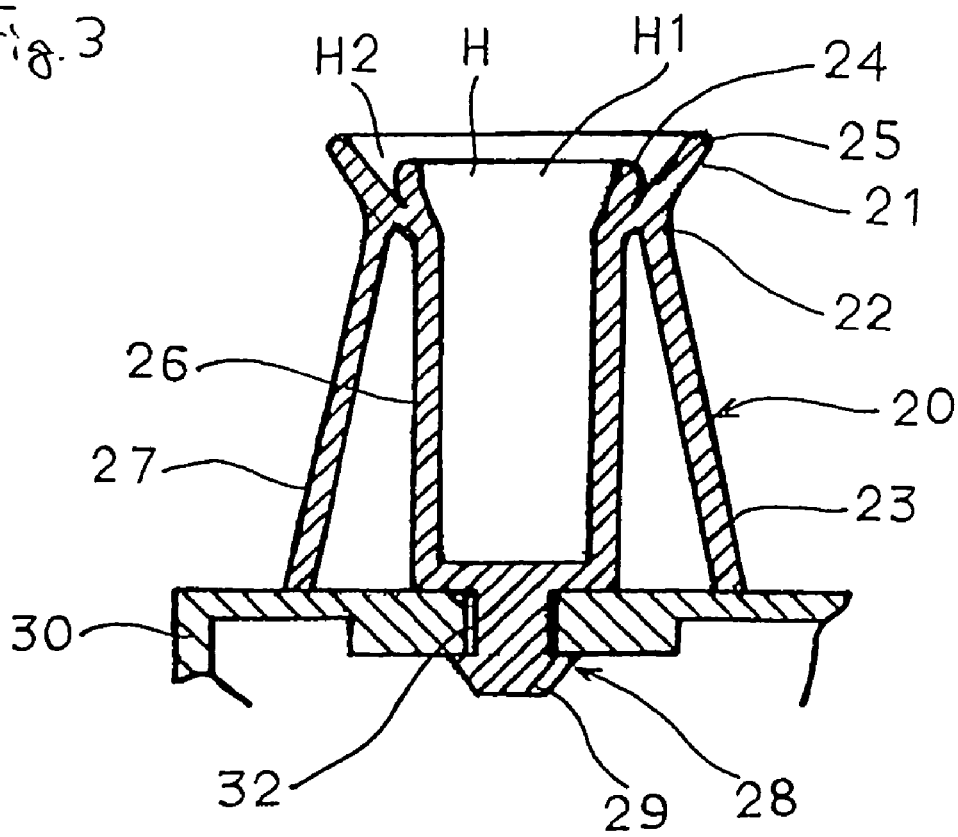
FIG. 3 is a main part cross sectional view showing a condition where the cap is attached to a slider.
Figure 4:
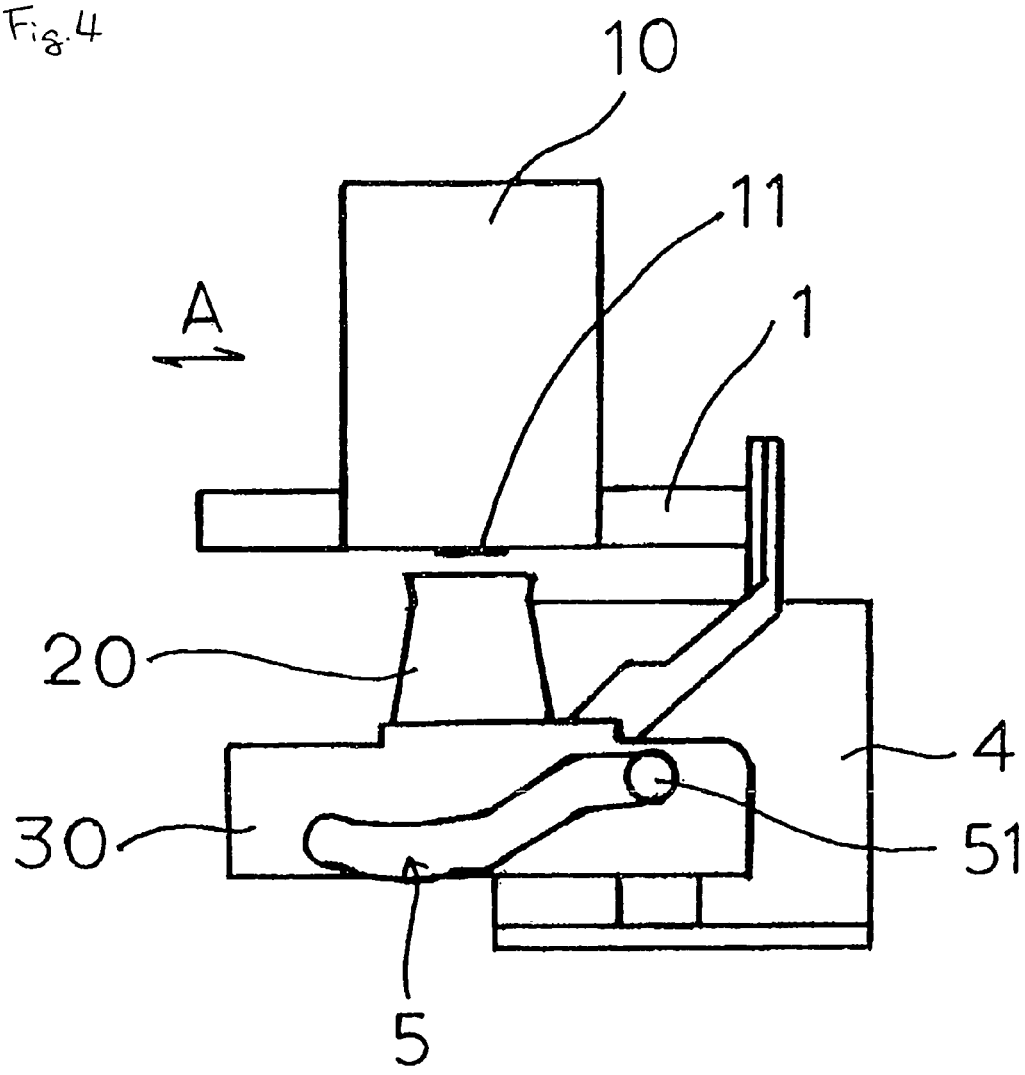
FIG. 4 is an operation explanatory view showing a condition where the ink cartridge withdraws from the printing operation region to a home position that is a non-printing region.
Figure 5:
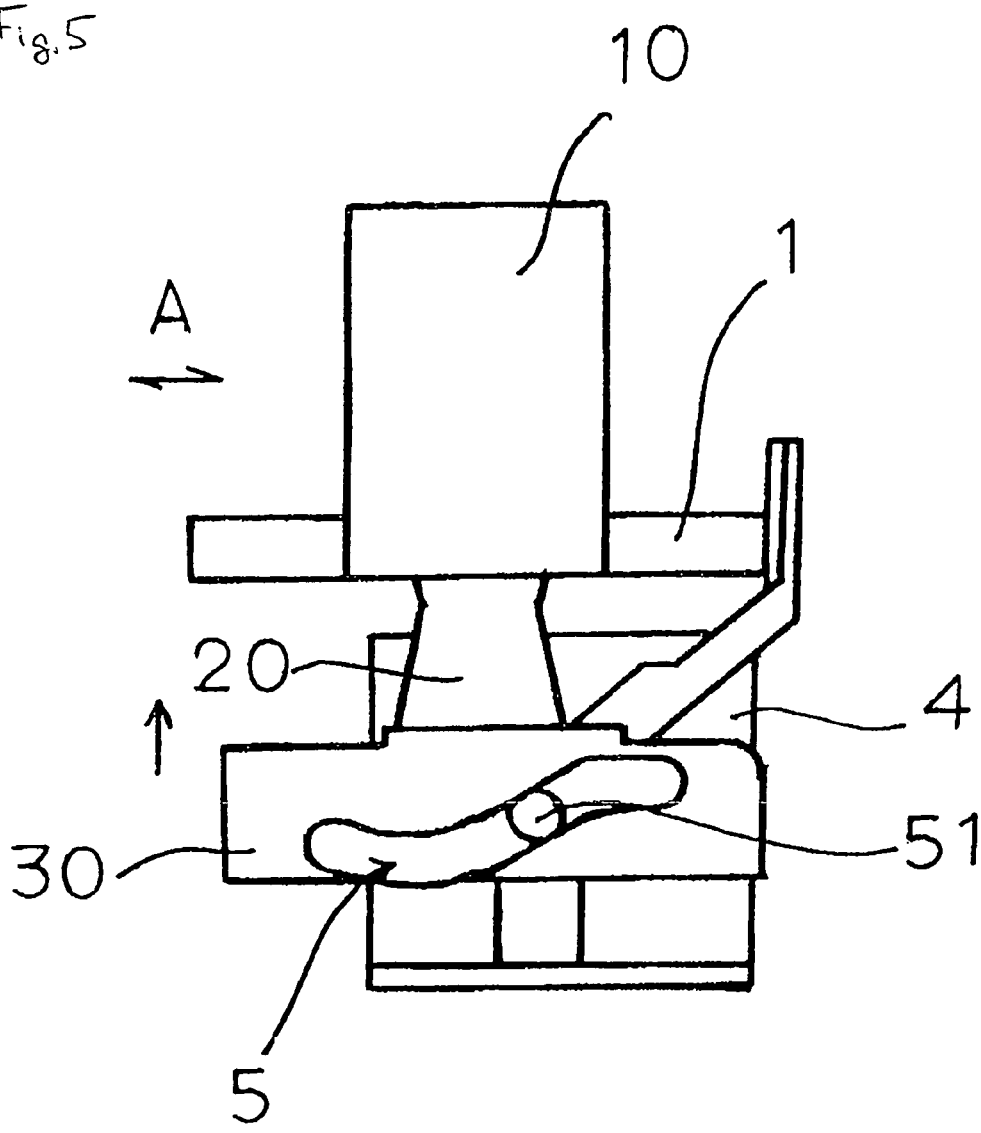
FIG. 5 is an operation explanatory view showing a condition where the ink cartridge withdraws to the withdrawn position side from FIG. 4 and the cap covers the head surface of the ink head.
Figure 6:
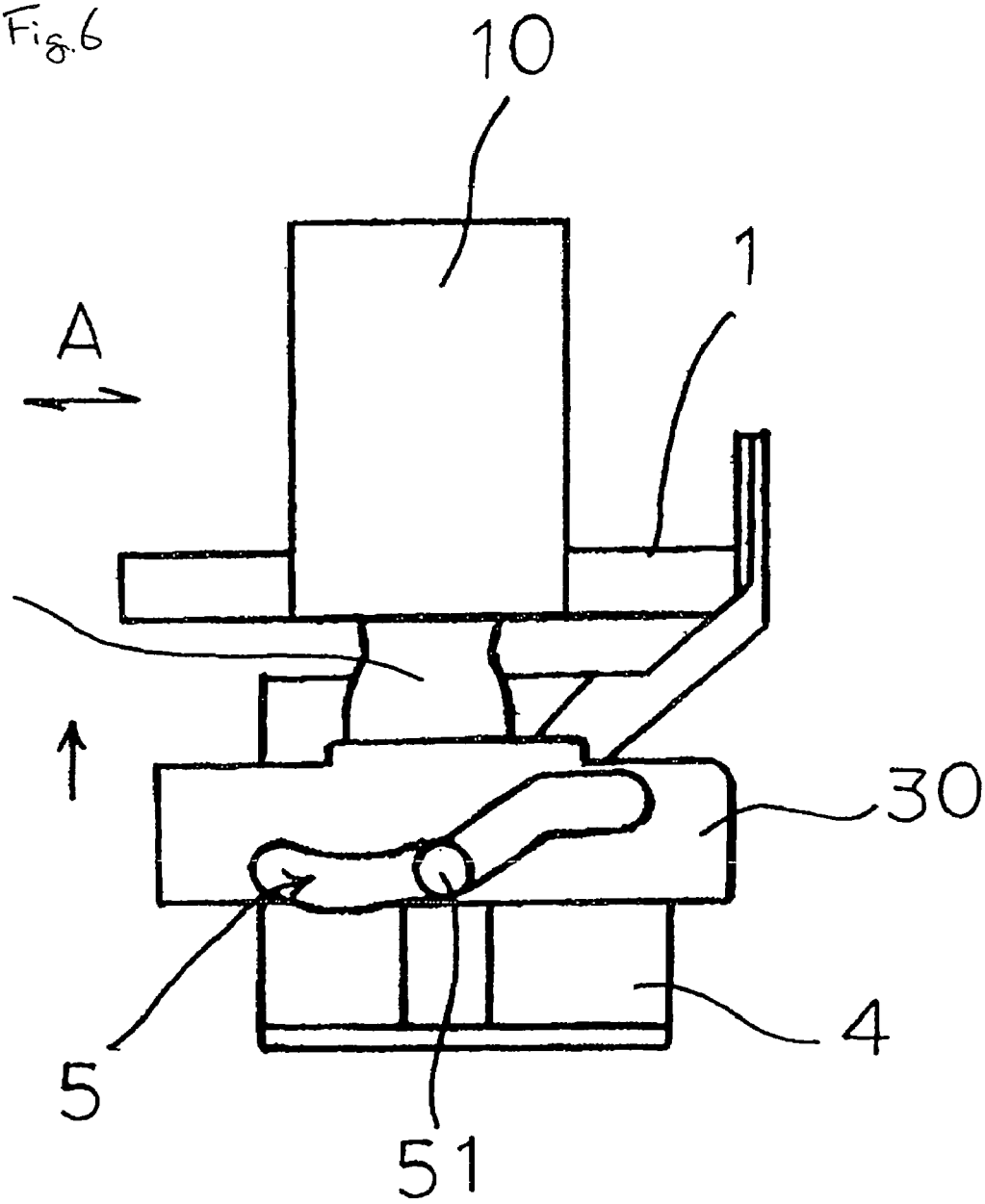
FIG. 6 is an operation explanatory view showing a condition where the ink cartridge withdraws to the withdrawn position side and is pushed up to the head surface side of the ink head.
Figure 7:
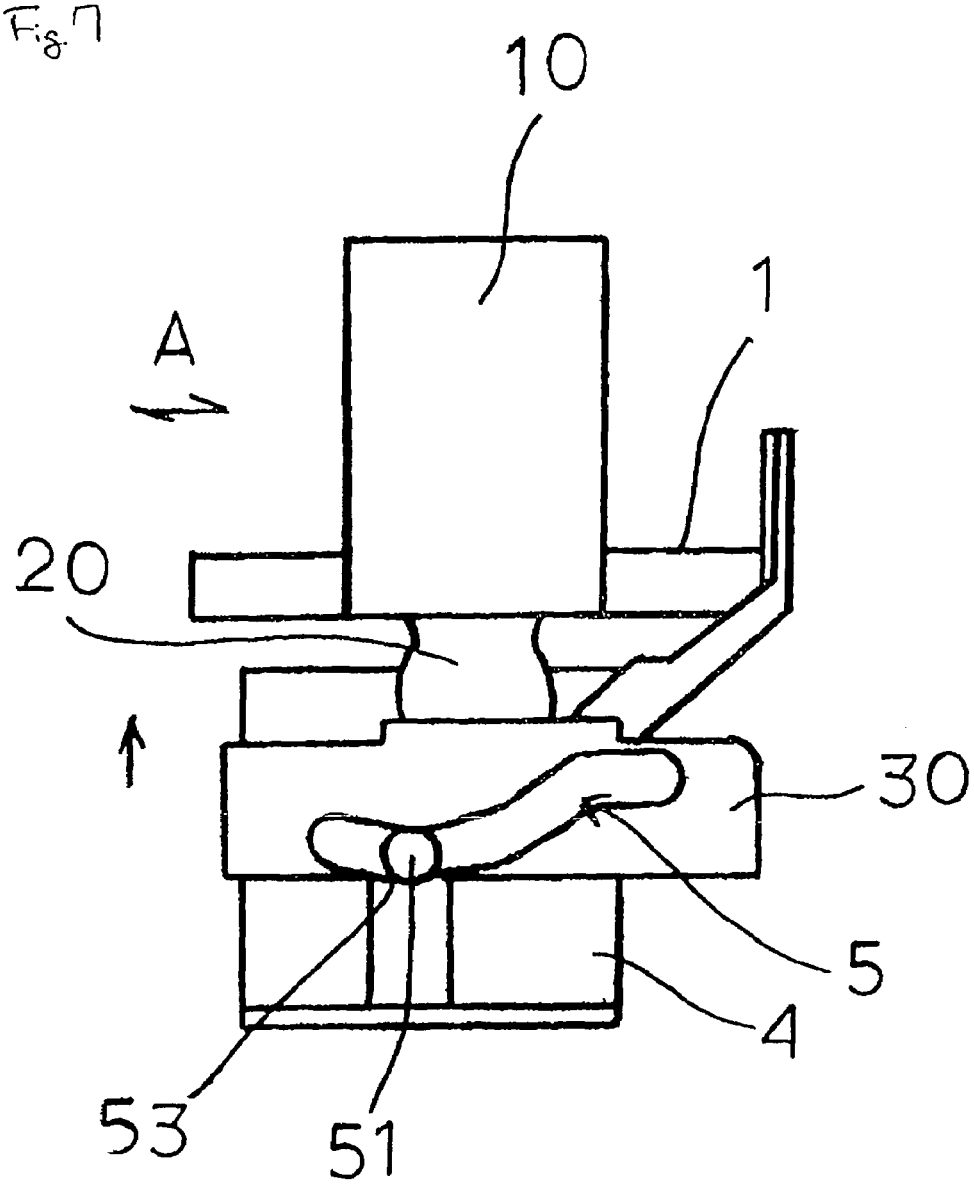
FIG. 7 is an operation explanatory view showing a condition where the ink cartridge further withdraws to the withdrawn position side from FIG. 6, and the cap is pushed up highest to the head surface side of the ink head.
Figure 8:
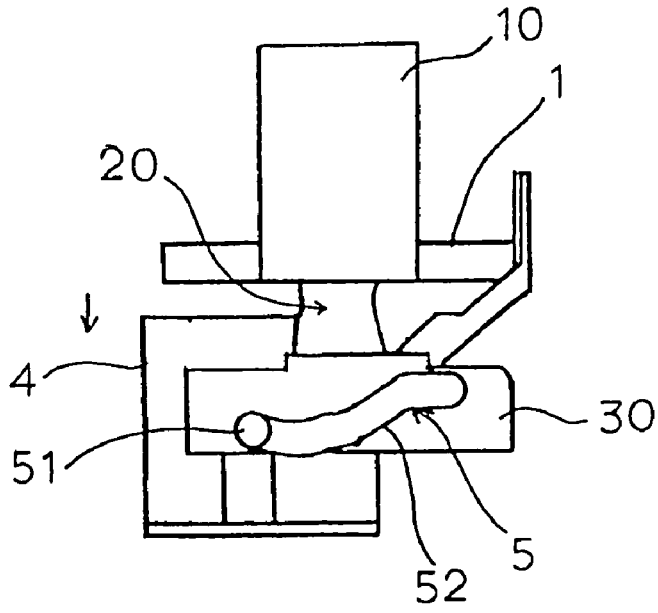
FIG. 8 is an operation explanatory view showing a condition where the ink cartridge withdraws to the withdrawn position, the cap slightly lowers from the head surface side of the ink head and the pressure inside the cap becomes negative.

FIG. 1 is a schematic constructional view showing a main part of a capping device of an inkjet recording apparatus according to an embodiment of the invention. FIG. 2A is a top view of an example of a cap, FIG. 2B is a front view of the cap, and FIG. 2C is a bottom view of the cap. FIG. 3 is a main part cross sectional view showing a condition where the cap is attached to a slider. FIG. 4 through FIG. 8 are views for describing the movement relationship between an ink cartridge and the capping apparatus, wherein FIG. 4 is an operation explanatory view showing a condition where the ink cartridge withdraws from a printing operation region to a home position of a non-printing region, FIG. 5 is an operation explanatory view showing a condition where the ink cartridge withdraws to its withdrawn position side and the cap covers the head surface of the ink head, FIG. 6 is an operation explanatory view showing a condition where the ink cartridge withdraws to its withdrawn position side and the cap is pushed up highest toward the head surface side of the ink head, FIG. 7 is an operation explanatory view showing a condition where the ink cartridge withdraws to its withdrawn position side and the cap is pushed up highest toward the head surface side of the ink head, and FIG. 8 is an operation explanatory view showing a condition where the ink cartridge withdraws to the withdrawn position from FIG. 7 and the cap lowers a little from the head surface side of the ink head and the pressure inside the cap becomes negative.

The reference numeral 1 denotes an ink holder, and to this ink holder 1, an ink cartridge 10 with a head surface 11 that jets ink from an ink jetting hole to an unillustrated printing medium is attached, and as shown by the arrow A, the ink cartridge is moved horizontally from a printing operation region (the upper left side of the figure) on the front side to a non-printing region (the upper right side of the figure) on the rear side along a guide rod that is not shown. The reference numeral 2 denotes a capping device, and this capping device 2 comprises a cap 20 that covers the head surface 11, a slider 30 which is attached with the cap on its upper part and is movable back and forth with respect to a fixed base 4 according to the movement of the ink holder 1, and an unillustrated spring or the like, and the slider 30 is elastically pressed by an unillustrated spring as shown in FIG. 1. The reference numeral 5 denotes a cam mechanism, and this cam mechanism 5 comprises a fixed shaft 51 provided in the base 4 and a cam rail 52 that is formed in the slider 30 and moves back and forth along the fixed shaft 51, and when the ink cartridge 10 moves within the home position, the capping device 2 moves accordingly and changes the inside of the cap 20 covering the head surface 11 from a positively pressurized status into a negatively pressurized status, and at a standby state, maintains the negatively pressurized status, and, for example, a downhill-shaped cam surface 53 that presses the cap 20 against the head surface 11 side so that the cap 20 adsorbs to the head surface 11 is formed on the cam rail 52. In this specification, the direction of advance of the ink cartridge 10 from the home position to the printing operation region side is referred to as forward, and the direction of withdrawal of the ink cartridge 10 to the home position of the non-printing region is referred to as backward.

The cap 20 is formed of an elastic member which is opened on its upper end portion 21 so as to cover the head surface 11 of the ink cartridge 10, narrowed at the middle portion 22, and widened toward its lower end portion 23, and is made of a material such as rubber (including a synthetic rubber) or a non-rigid plastic having an elastic force. In the specification, the term "middle portion" is used not as a dimensional center, but to define a portion between the upper end portion 21 and the lower end portion 23. The position, the dimensions, and the shape of the narrowed portion of the middle portion 22 are designed so that the cap 20 sufficiently works as a cap by considering the size (width, depth, and height), material, and shape of the cap 20 itself, and further considering its elastic force.

When the elastic force of the upper end portion 21 of the cap 20 is set higher than that of the lower end portion 23, since the upper end portion 21 of the cap 20 which comes into contact with the head surface 11 is soft, the head surface 11 can be covered softly and prevented from being damaged, and this is advantageous. That is, the cap 20 is configured to be more deformable at the upper end portion 21 than at the lower end portion 23. Furthermore, when the thickness of the upper end portion 21 of the cap 20 is made thinner than the thickness of the lower end portion 23, since the upper end portion 21 of the cap 20 which comes into contact with the head surface 11 is thin, the head surface 11 can be covered softly and prevented from being damaged, and this is advantageous.

In addition, the opening H of the upper end portion 21 of the cap 20 is formed double, and the upper end 24 of the inner opening H1 is set lower than the upper end 25 of the outer opening H2, whereby the upper end portion 21 of the cap 20 which comes into contact with the head surface 11 is formed double and this greatly improves air-tightness. Furthermore, the lower end portion 23 from the narrowed portion of the cap 20 is formed double by a cylindrical supporting part 26 which is communicated on its upper end with the opening H1 and has a bottom and a skirt part 27 which is positioned outside this supporting part 26 and widened from the narrowed portion toward the lower end, whereby the lower end portion 23 from the narrowed portion of the cap 20 has a double form including the cylindrical supporting part 26 and a skirt part 27 widened toward the lower end, so that its elastic force can be easily adjusted to a desired value by properly selecting the thicknesses and shapes of these parts, and this is advantageous. It is also possible that, when the cap 20 is attached to the slider 30, an attaching part 28 is formed by forming a projection 29 on the bottom of the supporting part 26 and the projection 29 is fitted into an attaching hole 32 formed in the slider 30. Thereby, it becomes unnecessary to use bolts and nuts to fix the cap 20, and this improves the attachment workability.

Next, operations of the inkjet recording apparatus equipped with the capping device 2 thus constructed are described with reference to FIG. 4 through FIG. 8. First, the ink holder 1 attached with the ink cartridge 10 as shown in FIG. 4 withdraws from the printing operation region to the home position of the non-printing region, and when it comes into contact with a projection 31 on the slider 30 of the capping device 2, the head surface 11 of the ink cartridge 10 comes just above the cap 20. From this point, the slider 30 gradually pushes up the entire capping device 2 as shown in FIG. 5 through FIG. 7 while withdrawing together with the ink holder 1 since the cam rail 52 of the slider 30 is guided by the fixed shaft 51 of the base 4. Then, when the lowest portion of the downhill-shaped cam surface 53 of the cam rail 52 is moved to the fixed shaft 51 as shown in FIG. 7, the inner capacity of the cap 20 becomes the minimum and a positively pressurized status is created in cap 20 by elastically deforming the cap. Thereafter, the slider 30 further withdraws to the withdrawn position side, and when it reaches the withdrawn position, in the slider 30, as shown in FIG. 8, the cap 20 slightly lowers from the head surface 11 side of the ink head 10, and the pressure inside the cap 20 becomes negative.

In the above mentioned embodiment, the head surface 11 is covered by the opening H of the upper end portion of the cap 20 formed of an elastic member narrowed at the middle portion 22 and widened toward the lower end portion 23, so that the pressing force is evenly applied to the entirety of the portion in contact with the head surface 11, whereby stable air-tightness can be secured for a long period of time. Furthermore, since the pressure inside the cap 20 covering the head surface 11 is changed from a positively pressurized status into a negative status by means of movement within the home position, and a negative status is maintained at a standby state, the cap adsorbs to the head surface 11 like a sucker, so that air-tightness is made very stable. Furthermore, due to a change in the inner capacity of the cap 11, the ink of the ink cartridge 10 is suctioned, whereby ink clogging is prevented and the nozzle is cleaned. This treatment can be carried out by the above mentioned movement within the home position, so that the treatment takes no time and requires no special suction pumps.

Figure 9:
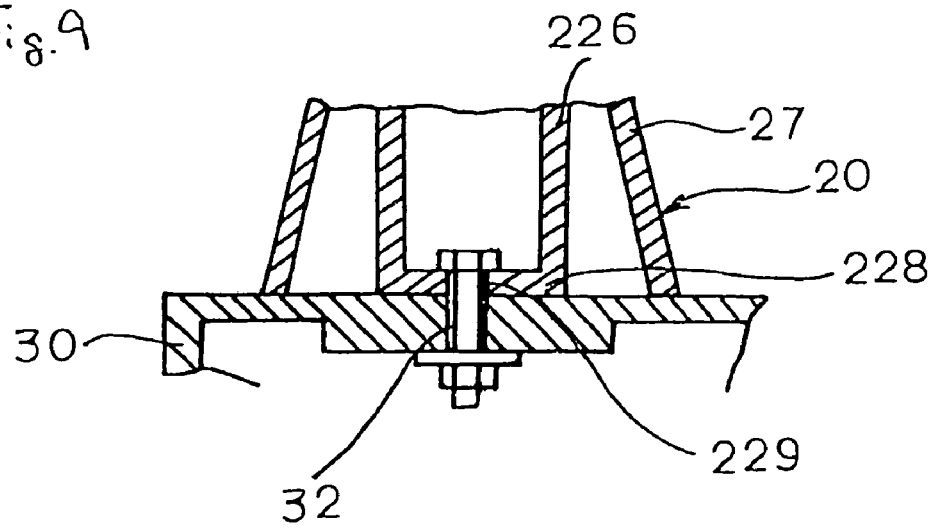
FIG. 9 is a main part cross sectional view showing another example of attachment of the cap to the slider.

As a matter of course, it is possible that, to attach the cap 20 to the slider 30, a through hole 229 corresponding to the attaching hole 32 of the slider 30 is formed in the bottom 228 of the supporting part 226 of the cap 20 as shown in FIG. 9, and attachment is carried out by using bolts and nuts so that the inside of the cap 20 becomes airtight when the cap 20 is closely attached to the head surface 11.

Figure 10:
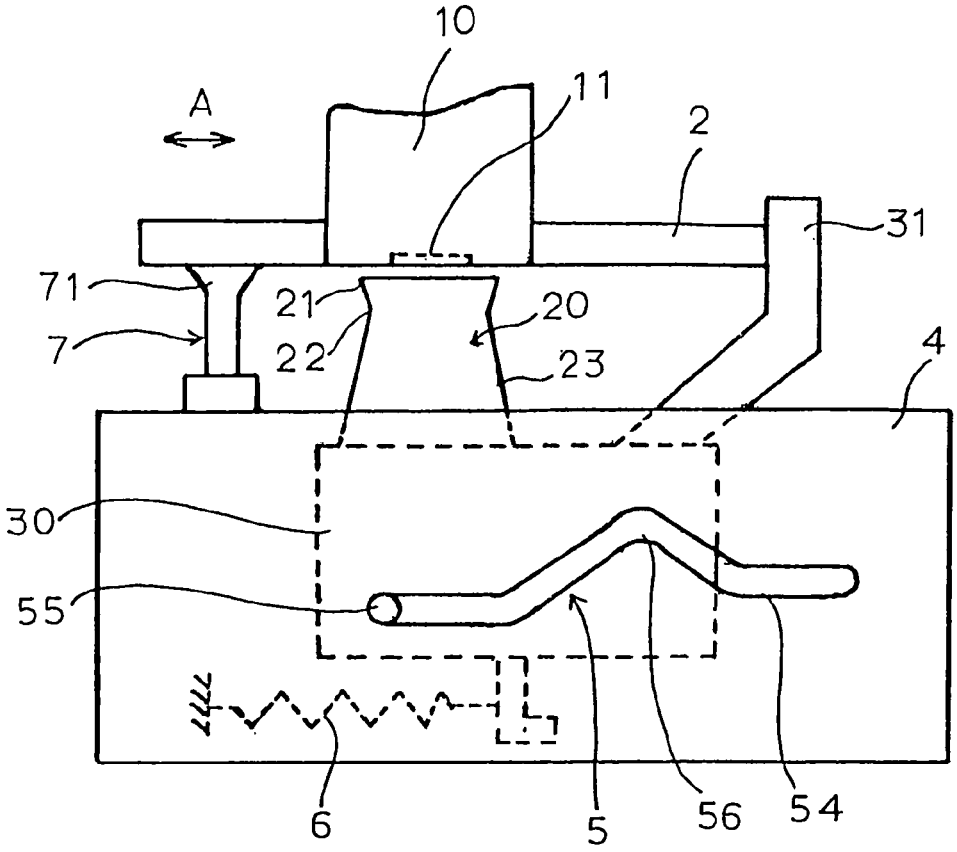
FIG. 10 is a schematic constructional view showing the main part of the capping device of the inkjet recording apparatus according to another embodiment of the invention.

Next, another embodiment of the invention shown in FIG. 10 is described. In this embodiment, the cam mechanism is constructed by providing a cam rail at the base side and a moving shaft at the slider side. The parts attached with the same symbols as those in FIG. 1 through FIG. 9 denote the same parts. Hereinafter, points of difference are mainly described.

FIG. 10 is a schematic constructional view showing the main part of the capping device of the inkjet recording apparatus.

In this embodiment, the cam mechanism 5 comprises a cam rail 54 provided in a fixed base 4 disposed near the home position, and a moving shaft 55 which is provided in a slider 30 movable back and forth within the base 4 and moves back and forth along the cam rail 54, and on the cam rail 54, an uphill-shaped cam surface 56 that presses the cap 20 against the head surface 11 side is formed. In the figure, the reference numeral 6 denotes a spring provided on the bottom of the base 4 for elastically pressing the slider 30 forward, and 7 denotes a head cleaning mechanism, and in both or either case where the ink cartridge 10 advances from the home position or it withdraws to the home position, a wiper 71 made of, for example, rubber comes into contact with the head surface 11 and cleans the head surface 11 by wiping the head surface 11.

According to this configuration, as in the case of the abovementioned embodiment, the head surface 11 is covered by the opening H of the upper end portion of the cap 20 formed of an elastic member that is narrowed at the middle portion 22 and widened toward the lower end portion 23, so that a pressing force is evenly applied to the entirety of the portion in contact with the head surface 11, whereby stable air-tightness can be secured for a long period of time. Only by forming an uphill-shaped cam surface 56 on the cam rail 54 formed in the base 4, by movement within the home position, that is, passing the moving shaft 55 though the uphill-shaped cam surface 56, the pressure inside the cap 20 covering the head surface 11 is changed from a positively pressurized status into a negatively pressurized status, and at a standby state, the negatively pressurized status is maintained and the cap adsorbs to the head surface 11 like a sucker, so that the air-tightness is made very stable. Furthermore, due to a change in the inner capacity of the cap 11, the ink of the ink cartridge 10 is suctioned, whereby ink clogging is prevented and the nozzle is cleaned. In addition, since this treatment is carried out by the abovementioned movement within the home position, the treatment takes no time and requires no special suction pumps.

Furthermore, the above-described embodiments are preferable embodiments of the invention, and the invention is not limited to these and is variously changeable without deviating from the spirit of the invention. For example, in the respective embodiments described above, one ink cartridge is set to the ink holder, however, as a matter of course, the invention is applicable to a so-called multi-type inkjet recording apparatus in which two ink cartridges are set to the ink holder.

According to a first aspect of the invention, since the head surface is covered by the opening on the upper end portion of the cap which is formed of an elastic member, narrowed at the middle portion, and widened toward the lower end, a pressing force is evenly applied to the entirety of the portion in contact with the head surface, whereby stable air-tightness can be secured for a long period of time. In addition, by the movement within the home position, the inside of the cap covering the head surface is changed from a positively pressurized status into a negatively pressurized status, and at a standby state, the negatively pressurized status is maintained and the cap adsorbs to the head surface like a sucker, so that the air-tightness becomes very stable. Furthermore, due to a change in the inner capacity of the cap, the ink of the ink cartridge is suctioned, whereby ink clogging is prevented and simultaneously, the nozzle is cleaned. This treatment is carried out by the abovementioned movement within the home position, so that the treatment takes no time and requires no special suction pumps.

According to a second aspect of the invention, the head surface is covered by the opening of the upper end portion of the cap which is formed of an elastic member, narrowed at the middle portion, and widened toward the lower end, so that a pressing force is evenly applied to the entirety of the portion in contact with the head surface, whereby stable air-tightness can be secured for a long period of time.

According to a third aspect of the invention, by the movement within the home position, the inside of the cap covering the head surface is changed from a positively pressurized status into a negatively pressurized status, and at a standby state, the negatively pressurized status is maintained and the cap adsorbs to the head surface like a sucker, so that the air-tightness becomes stable. Furthermore, due to a change in the inner capacity of the cap, the ink of the ink cartridge is suctioned, whereby ink clogging is prevented and the nozzle is cleaned. Furthermore, this treatment is carried out by the abovementioned movement within the home position, the treatment takes no time and requires no special suction pumps.

According to a fourth aspect of the invention, since the head surface is covered by the opening of the upper end portion of the cap which is formed of an elastic member, narrowed at the middle portion, and widened toward the lower end, a pressurizing force is evenly applied to the entirety of the portion in contact with the head surface, whereby stable air-tightness can be secured for a long period of time. In addition, by the movement within the home position, the inside of the cap covering the head surface is changed from a positively pressurized status into a negatively pressurized status, and at a standby state, the negatively pressurized status is maintained and the cap adsorbs to the head surface like a sucker, so that the air-tightness becomes very stable. Furthermore, due to a change in the inner capacity of the cap, the ink of the ink cartridge is suctioned, whereby ink clogging is prevented and the nozzle is cleaned. In addition, since this treatment is carried out by the abovementioned movement within the home position, the treatment takes no time and requires no special suction pumps.

According to a fifth aspect of the invention, the head surface is covered by the opening of the upper end portion of the cap which is formed of an elastic member, narrowed at the middle portion and widened toward the lower end, so that a pressing force is evenly applied to the entirety of the portion in contact with the head surface, whereby stable air-tightness can be secured for a long period of time.

According to a sixth aspect of the invention, the upper end portion of the cap which comes into contact with the head surface is soft, so that the head surface can be covered softly and prevented from being damaged, and this is advantageous.

According to a seventh aspect of the invention, since the upper end portion of the cap which comes into contact with the head surface is thin, the head surface can be covered softly and prevented from being damaged, and this is advantageous.

According to an eighth aspect of the invention, the upper end portion of the cap which comes into contact with the head surface has a double form, so that the air-tightness is excellent.

According to a ninth aspect of the invention, the lower side portion from the narrowed portion of the cap has a double form including a cylindrical supporting part and a skirt part widened downward, so that the elasticity can be extremely easily adjusted.

According to a tenth aspect of the invention, the cap is fixed by fitting the projection formed on the tip end of the attaching part into the attaching hole formed in the slider, without using bolts and nuts, and this improves the attachment workability.

According to an eleventh aspect of the invention, by the movement within the home position, the inside of the cap covering the head surface is changed from a positively pressurized status into a negatively pressurized status, and at a standby state, the negatively pressurized status is maintained and the cap adsorbs to the head surface like a sucker, so that the air-tightness becomes stable. Furthermore, due to a change in the inner capacity of the cap, the ink of the ink cartridge is suctioned, whereby ink clogging is prevented and the nozzle is cleaned. In addition, this treatment is carried out by the abovementioned movement within the home position, so that the treatment takes no time and requires no special suction pumps.

According to a twelfth aspect of the invention, only by forming a downhill-shaped cam surface on the cam rail formed in the slider, the cap can be pressed against the head surface side, and this prevents ink clogging, so that this is advantageous.

According to a thirteenth aspect of the invention, only by forming an uphill-shaped cam surface on the cam rail formed in the base, the cap can be pressed against the head surface side and this prevents ink clogging, and this is advantageous.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. An inkjet recording apparatus that carries out recording by jetting ink onto a recording medium by using an ink cartridge of inkjet type which ejects ink from an ink jetting hole, the inkjet recording apparatus comprising:

a base fixedly disposed near a home position of the ink cartridge;

a slider that moves back and forth with respect to the base in a direction of a movement direction of the ink cartridge; and a cap disposed on the slider at a side opposing a head surface of the ink cartridge and being formed of an elastic member which is opened on an upper end portion thereof, narrowed at a middle portion thereof, and widened toward a lower end portion thereof, the upper end portion being configured to cover the head surface of the ink cartridge, wherein the cap is formed in a double structure having an inner opening and an outer opening at the upper end portion, and an upper end of the inner opening is formed to be lower than an upper end of the outer opening, wherein the cap is formed in a double structure at a portion from the middle portion to the lower end portion, the double structure having a cylindrical supporting part being communicated at an upper end thereof with the inner opening and having a bottom end portion being formed with an attaching part thereon; and a skirt part that widens from the middle portion toward the lower end portion.

2. The inkjet recording apparatus according to claim 1, wherein the cap is formed in a hollow shape.

3. The inkjet recording apparatus according to claim 1, wherein the attaching part has a projection formed at a tip end thereof, and wherein the slider has an attaching hole into which the projection is to be fitted.

4. The inkjet recording apparatus according to claim 1, wherein the cap is configured to be more deformable at the upper end portion than at the lower end portion.

5. The inkjet recording apparatus according to claim 4, wherein the cap is formed to be thinner at the upper end portion than at the lower end portion.

6. The inkjet recording apparatus according to claim 1 further comprising a cam mechanism configured to change an inner status of the cap into a negatively pressurized status by elastically deforming the cap when the ink cartridge moves within the home position, and to maintain the cap to be absorbed to the head surface with the negatively pressurized status when the ink cartridge is in a standby state in the home position.

7. The inkjet recording apparatus according to claim 6, wherein the cam mechanism changes the inner status of the cap into a negatively pressurized status after changing the inner status of the cap into a positively pressurized status by elastically deforming the cap.

8. The inkjet recording apparatus according to claim 6, wherein the cam mechanism includes:

a fixed shaft provided in a fixed base that is disposed near the home position; and a cam rail formed in the slider and configured to be movable back and forth along the fixed shaft, the cam rail being formed thereon a downhill-shaped cam surface that presses the cap against the head surface.

9. The inkjet recording apparatus according to claim 6, wherein the cam mechanism includes:

a cam surface provided in the base disposed near the home position; and a moving shaft formed in the slider to be movable back and forth with respect to the base and to be movable back and forth along the cam surface, the moving shaft being formed thereon an uphill-shaped cam surface that presses the cap against the head surface.

10. A system that performs inkjet recording by jetting ink onto a recording medium using an inkjet-type ink cartridge that ejects ink from an ink jetting hole, the system comprising:

a base fixedly disposed at a non-printing region of the ink cartridge;

a slider that moves horizontally with respect to the base according to movement of the ink cartridge;

a cap disposed on the slider at a side opposing a head surface of the ink cartridge and being formed of an elastic member which is open on an upper end portion thereof, narrowed at a middle portion thereof, and widened toward a lower end portion thereof, the upper end portion being configured to cover the head surface of the ink cartridge; and a cam mechanism configured to change an inner status of the cap into a negatively pressurized status by way of movement of the cartridge within the home position, wherein the cam mechanism includes a cam rail that moves with respect to a fixed shaft in the base, wherein the cam rail includes a lower cam surface that, when moved to the fixed shaft, deforms the cap into a first position that minimizes an inner capacity of the cap, and a raised cam surface that, when moved to the fixed shaft, deforms the cap from the first position into a second position that effects the negatively pressurized status.

* * * * *